US006817358B1

(12) United States Patent
Resnick

(10) Patent No.: US 6,817,358 B1
(45) Date of Patent: Nov. 16, 2004

(54) PROTECTIVE HOOD WITH ADJUSTABLE VISOR

(76) Inventor: Todd A. Resnick, P.O. Box 1559, Stuart, FL (US) 34995-1559

( * ) Notice: Subject to any disclaimer, the term of this patent is extended or adjusted under 35 U.S.C. 154(b) by 0 days.

(21) Appl. No.: 10/248,070

(22) Filed: Dec. 16, 2002

(51) Int. Cl.[7] ..... A62B 17/04; A62B 19/00

(52) U.S. Cl. ..... 128/201.22; 128/201.25; 128/201.23

(58) Field of Search ..... 128/200.24, 200.27, 128/200.28, 201.12, 201.14, 201.15, 201.17, 201.22, 201.23, 201.24, 201.25, 201.29, 202.11, 202.19, 205.25, 206.16, 206.19, 206.17, 206.21, 206.23, 206.24, 206.26, 206.27, 207.11; 2/6.3, 6.7, 171, 171.2, 173, 427, 429, 435, 438

(56) References Cited

U.S. PATENT DOCUMENTS 2,631,287 A * 3/1953 Malcom, Jr. ..... 2/9
2,799,862 A * 7/1957 Rowe ..... 2/9
2,918,060 A * 12/1959 Lobelle ..... 128/201.24
3,310,811 A * 3/1967 Iacono ..... 2/6.5
3,528,415 A * 9/1970 Malmin ..... 128/201.12
4,090,509 A * 5/1978 Smith ..... 128/202.19
4,709,696 A * 12/1987 Angell ..... 128/201.12
4,764,990 A * 8/1988 Markert ..... 2/429
4,870,959 A * 10/1989 Reisman et al. ..... 128/201.25
5,235,972 A * 8/1993 Strong ..... 128/206.21
5,261,398 A * 11/1993 Sobolik ..... 128/206.23
5,349,949 A * 9/1994 Schegerin ..... 128/206.24
5,421,326 A * 6/1995 Rankin et al. ..... 128/201.19
5,549,104 A * 8/1996 Crump et al. ..... 128/201.25
5,628,308 A * 5/1997 Harges et al. ..... 128/206.21
5,653,225 A * 8/1997 Schegerin ..... 128/201.24
5,682,879 A * 11/1997 Bowers ..... 128/206.19
5,704,073 A * 1/1998 Sword et al. ..... 2/427
5,823,188 A * 10/1998 Harges et al. ..... 128/206.19
6,302,103 B1 * 10/2001 Resnick ..... 128/201.23
6,681,765 B2 * 1/2004 Wen ..... 128/201.25

OTHER PUBLICATIONS

Merriam–Webster's Collegiate Dictionary, 10th Ed., p. 557.*

* cited by examiner

*Primary Examiner*—Henry Bennett
*Assistant Examiner*—Teena Mitchell
(74) *Attorney, Agent, or Firm*—Anton J. Hopen; Smith & Hopen, P.A.

(57) ABSTRACT

A protective apparatus including a flexible hood provided with a visor movable from a distal position to a proximate position relative to the ocular area of a wearer of the hood and a slack fold coincident to a bottom portion of the visor providing the visor with a range of movement defined by the distal and proximate positions.

16 Claims, 6 Drawing Sheets

FIG. 5
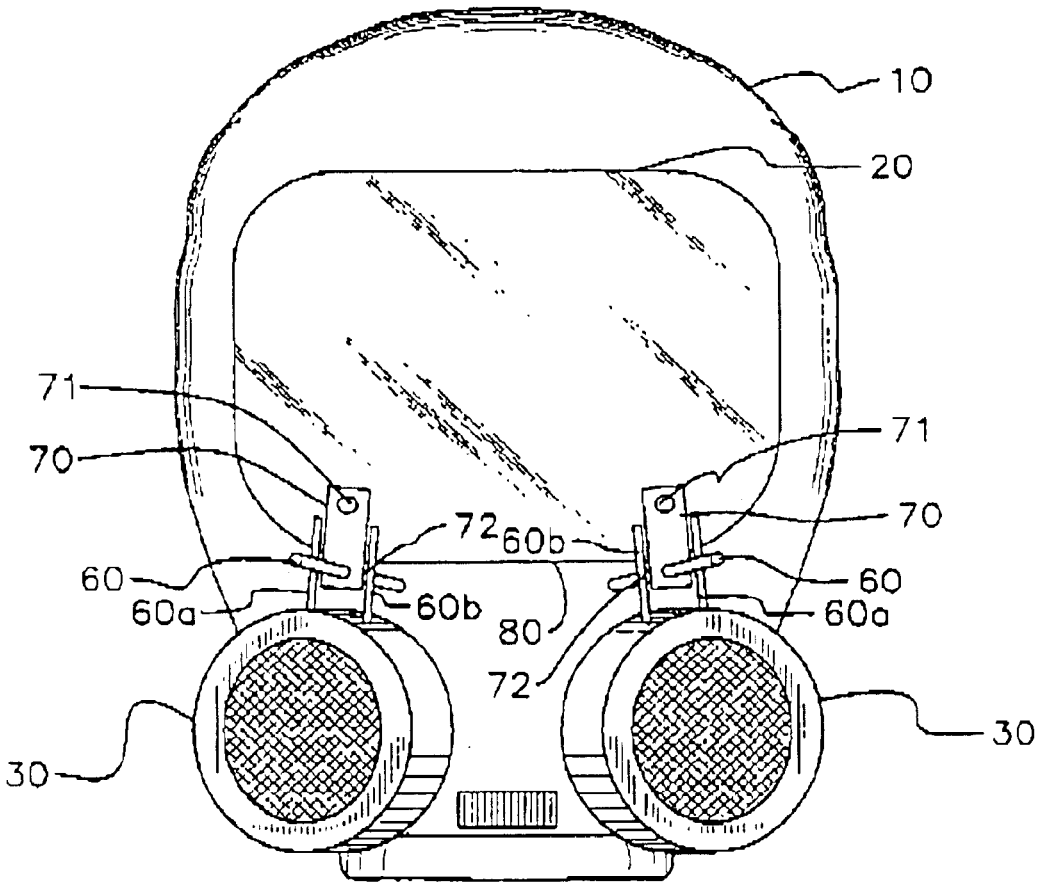
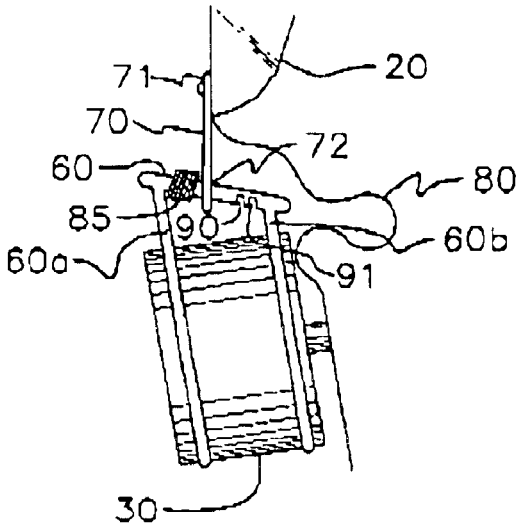
FIG. 6

FIG. 7
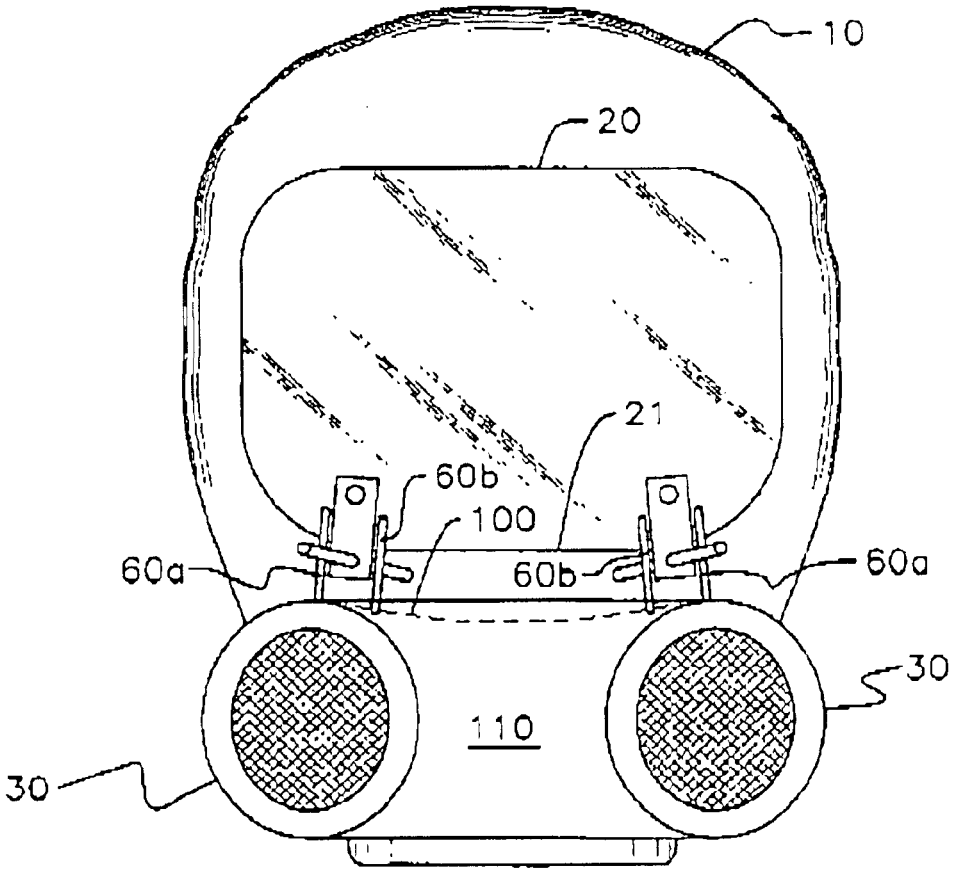
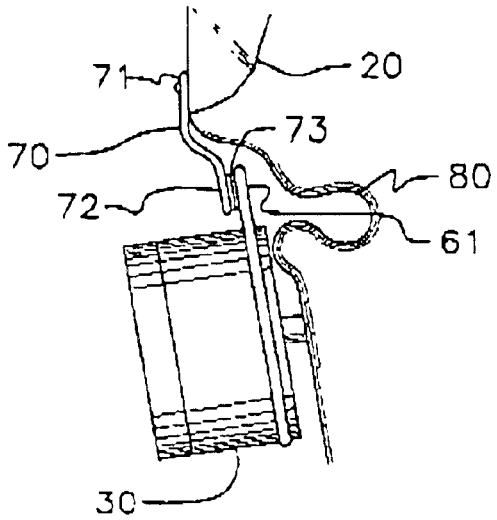
FIG. 8

PROTECTIVE HOOD WITH ADJUSTABLE VISOR

SUMMARY OF THE INVENTION

1. Field of Invention

This invention relates to a protective wear, and more particularly, to a protective hood with an adjustable visor.

2. Summary of Invention

The present invention is a flexible hood provided with a visor movable from a distal position to a proximate position relative to the ocular area of a wearer of the hood and a slack fold coincident to a bottom portion of the visor providing the visor with a range of movement defined by the distal and proximate positions. As the visor is moved towards the ocular area of the wearer (the person's eyes), the peripheral vision afforded by the visor increases. By moving the visor in close proximity to the wearer's eyes, the size requirements of the visor may be reduced while still providing acceptable outward vision. Furthermore, by making the visor adjustable, outward vision can be optimized for a wide range of facial profiles including persons wearing eyeglasses. A restraint means is provided to align the vertical position of the vision with the ocular area of the wearer when the visor is in the proximate position. Without the restrain means, the slack fold would permit the visor to move towards the wearer's forehead and thus not be vertically aligned with the ocular area for proper outward vision.

An alterative embodiment to the invention may replace the slack fold with bellows, either interfaced into the hood or integral in a dip molded, all-rubber hood. The slack and the bellows form substantially the same function to provide the visor with travel towards the ocular area of the wearer.

In one embodiment of the invention, at least one substantially horizontal elongate member having a lengthwise axis in transverse, underlying relation to the visor is provided. A guide member having a first end and a second end is also provided. The first end of the guide member is secured to the visor and the second end is slideably received by the elongate member whereby movement of the visor to and from the distal and proximate positions is linearly restrained by the lengthwise axis of the at least one substantially horizontal elongate member. Preferably, the at least one substantially horizontal elongate member is downwardly angled from a horizontal plane whereby the visor is positioned lower relative to the ocular area when in the proximate position and the visor is positioned higher relative to the ocular area when in the distal position. The downward angle provides a correction for vertical outward visibility.

A locking means may be provided to secure the guide member at a location in the at least one elongate member representative of the proximate position of the visor. In one embodiment, at least one notch integral to the guide member is provided. The at least one notch is positioned in transverse relation to the lengthwise axis and is adapted to secure the guide member at a location in the at least one elongate member representative of the proximate position of the visor. A plurality of notches may be employed similar to serrations wherein multiple visor proximity positions may be easily selected. In another embodiment of the invention, the locking means may include a hook and loop interface to secure the guide member at a location in the at least one elongate member representative of the proximate position of the visor. In still another embodiment of the invention a snap button secures the guide member at a location in the at least one elongate member representative of the proximate position of the visor. In yet another embodiment of the invention the guide member is formed of an elastomeric material forming a resilient, interference fit with the at least one elongate member. When negative pressure exists in the hood, the visor may be drawn toward the wearer's face. By utilizing the locking means, the visor is restrained from unwanted movement.

Protective hoods, particularly those that are packaged with a respiratory filter are often constructed with flexible visors made of PVC, polycarbonate, polyester, urethane or the like. Selection of the appropriate visor material is often dependent on costs, heat resistance, anti-fog qualities, transparency, chemical resistances, storage life and the like. Virtually all suitable flexible visor materials will crease if stored in a folded configuration, particular when stored at high temperatures. Creases in the visor distort outward visor and are therefore undesirable. One advantage of the present invention is its ability to compactly fold with a filter without creasing the visor.

Respiratory filters are typically positioned in front of the wearer's mouth and thus, disposed underneath the visor of the hood. When packaging the respiratory hood for storage it is desirable to make the overall size of the unit as compact as possible. As described above, it is also desirable to avoid folding the visor whereby creases may form and inhibit outward visibility. If the visor is configured in the hood in close proximity to the ocular area of the wearer, good peripheral vision is achieved. However, the visor cannot lay flat over the substantially rigid filters and creases form in the visor. Alternatively, the visor may be positioned away from the ocular area so that it folds without creases onto the filters during storage. However, the visor is now positioned away from the eyes of the wearer resulting in poor peripheral vision.

The aforementioned problems are overcome by providing at least one filter coupled to the hood and disposed below the visor, the at least one filter having at least one substantially planer surface while the apparatus is in a packaged state. A fold line in the hood is coincident and parallel to the lower portion of the visor wherein the fold line abuts an edge of the substantially planer surface while the visor is in the distal position, the visor lying flat against the substantially planer surface while the apparatus is in a packaged state. The at least one substantially planer surface may be integral to the at least one filter or detachable from the at least one filter when the apparatus is in an unpackaged state. The planer surface also permits the visor to be constructed of a substantially rigid material such as glass or acrylic with superior optical properties for outward vision.

BRIEF DESCRIPTION OF DRAWINGS

For a fuller understanding of the nature and objects of the invention, reference should be made to the following detailed description, taken in connection with the accompanying drawings, in which:

FIG. 5 is a front elevation view of an embodiment of the invention.

FIG. 6 is a side elevation detail view of an embodiment of the invention.

FIG. 7 is a front elevation view of an embodiment of the invention having a substantially planer surface for receiving the visor in flat juxtaposition.

FIG. 8 a side elevation detail view of an embodiment of the invention.

DETAILED DESCRIPTION

Figure 1:
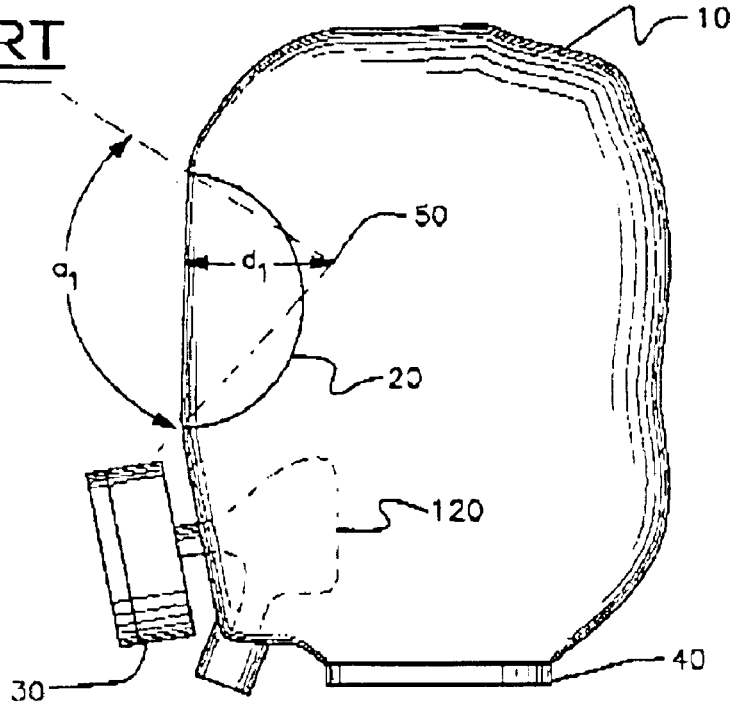
FIG. 1 PRIOR ART
FIG. 1 is a side elevation view of a prior art hood having a visor in relative close proximity to the ocular area of the wearer.
Figure 2:
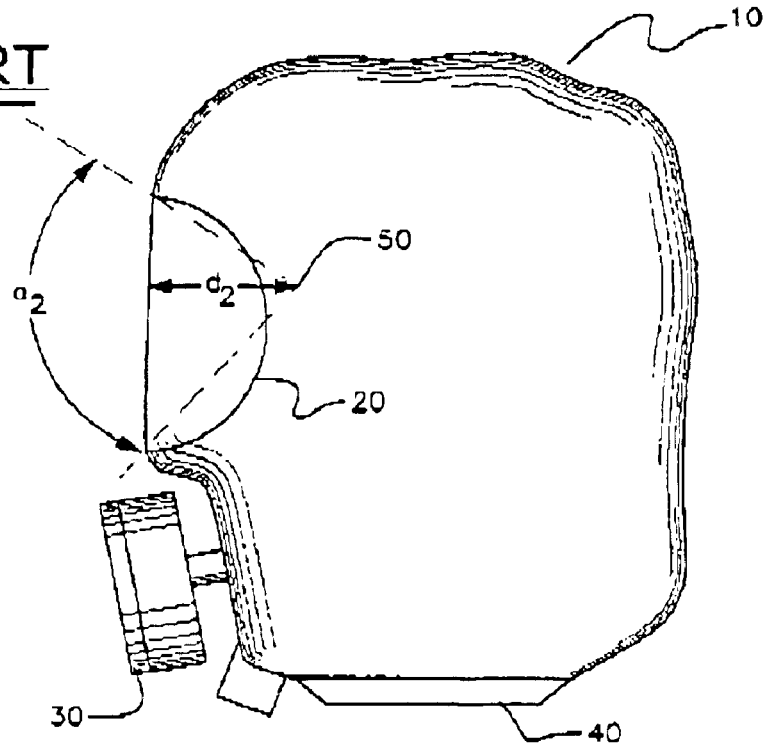
FIG. 2 PRIOR ART
FIG. 2 is a side elevation view of a prior art hood having a visor in relative distant proximity to the ocular area of the wearer.

Referring to prior art FIGS. 1 and 2, flexible hood 10 is provided with visor 20. Filter 30 is disposed below visor 20. The hood illustrated is neck sealable 40 in this exemplary embodiment. The origin of vision for the wearer is noted as vision epicenter 50. The distance between the visor 20 and vision epicenter 50 in FIG. 1 is represented by $d_1$ and in FIG. 2 by $d_2$. Peripheral vision angle $\alpha_1$ of FIG. 1 is greater than peripheral vision angle $\alpha_2$ of FIG. 2. The greater angle affords the wearer superior peripheral vision. Accordingly, it can be seen that moving the visor closer to the eyes of the wearer (the ocular area) is desirable to enhance outward visibility. Furthermore in most instances, the preferred location of the visor while the hood is being worn is the position directly above the breathing interface inside the hood.

Figure 3:
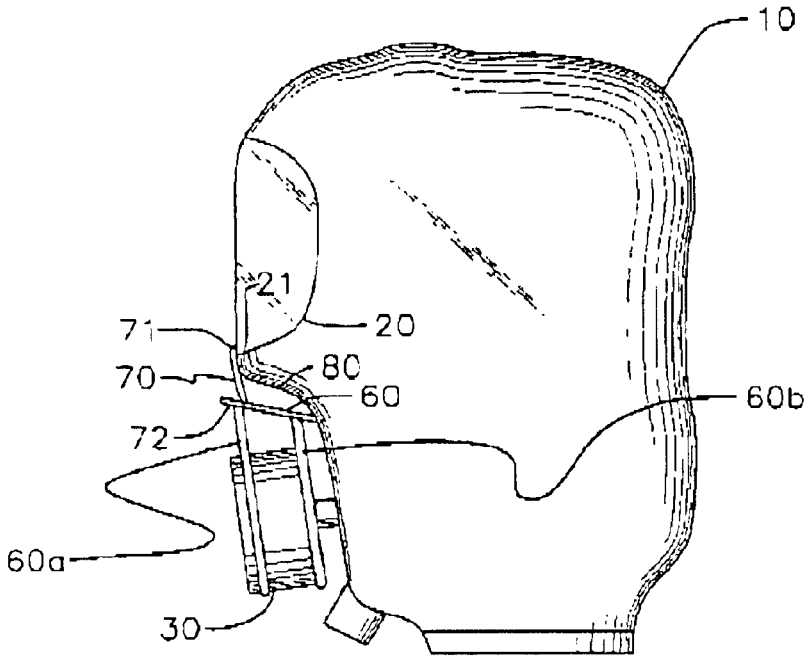
FIG. 3 is a side elevation view of an embodiment of the invention wherein the visor is in a distal position relative to the ocular area of the wearer.
Figure 4:
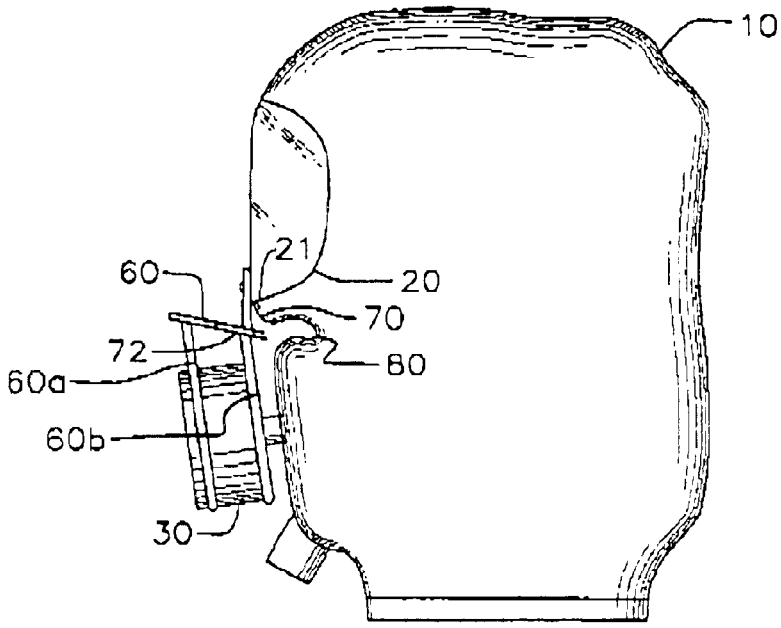
FIG. 4 is a side elevation view of an embodiment of the invention wherein the visor is in a proximate position relative to the ocular area of the wearer.

FIGS. 3 and 4 depict a preferred embodiment of the invention. Rod 60 is secured to filter 30 by forward support leg 60*a* and rearward support leg 60*b*. Accordingly, rod 60 is vertically spaced apart from filter 30. It should also be observed that rod 60 has a longitudinal axis of symmetry that is disposed substantially perpendicular to the plane of visor 20. As depicted in FIGS. 3 and 4, the plane of the visor is perpendicular to the plane of the visor. Thus, as drawn, rod 60 is in the plane of the paper. Guide member 70 has first end 71 secured to visor 20 and second end 72 is apertured to slideably receive rod 60. In a preferred embodiment of the invention, second end 72 and rod 60 are slideably coupled to one another by a mechanical interference fit that permits an infinite number of positions of functional adjustment. It is also preferred that an adjustment tab, not depicted, be integrated to guide member 70 wherein the user can easily grip and adjust guide member 70. It is also anticipated that first end 71 may be alternatively secured to hood 10 in close proximity to visor 20 to achieve substantially the same mechanical effect. Movement of guide member 70 and hence of visor 20 from the distal or extended position of FIG. 3 to the proximate or retracted position of FIG. 4 is accomplished by sliding guide member 70 along the length of rod 60 in a left-to-right direction as drawn. Movement of guide member 70 and hence of visor 20 from the retracted position of FIG. 4 to the expanded position of FIG. 3 is accomplished by sliding guide member 70 along the length of rod 60 in a right-to-left direction as drawn in said Figures. Rod 60 may be provided in a substantially horizontal orientation relative to a wearer standing upright. Preferably, rod 60 is downwardly angled from a horizontal plane whereby visor 20 is positioned lower relative to the ocular area of the wearer when in the proximate position of FIG. 4 and visor 20 is positioned higher relative to the ocular area when in the distal position of FIG. 3. Slack fold 80 is formed in hood 10 just below visor 20 when guide member 70 is displaced from its FIG. 3 position to its FIG. 4 position. Note the lower half, or filter-including part of the novel hood, is recessed with respect to the top half, or visor-including part of the hood when said hood is in repose as illustrated in FIG. 3. Note further that when hood 10 is in said position of repose, visor 20 is substantially co-planar with the front of filter 30. When visor 20 is in its retracted position, as illustrated in FIG. 4, visor 20 is substantially co-planar with the back of said filter 30. Significantly, as indicated by a comparison of FIGS. 3 and 4, the filter-including lower part of the novel hood has a fixed position that is unaffected by movement of the upper, visor-including part of said hood.

FIG. 5 is a front elevation view of an embodiment of the invention with two filters 30. As in the first embodiment, slack fold 80 is formed in visor 20 when guide member 70 is slidingly displaced along the length of rod 60 in a direction toward visor 20. A detailed view of of rod 60 is provided in FIG. 6 wherein notches 90 and 91 are formed in rod 60. Said notches engage and secure guide member 70 and hence visor 20 at preselected retracted positions. In FIG. 6, spring 85 is sandwiched between forward support leg 60*a* and guide member 70. Spring 85 is under compression and therefore resiliently biases guide member 70 and visor 20 towards the ocular area of the wearer. In a preferred embodiment, the apparatus is packaged with the spring under tension whereby upon unpacking, spring 85 automatically moves guide member 70 and visor 20 towards the ocular area of the wearer (the proximate or retracted position). Alternatively, spring 85 may be under tension and positioned on the opposite side of guide member 70 to pull visor 20 to the proximate position.

In FIG. 7, fold line 100 in hood 10 is substantially parallel to visor bottom 21 and permits visor 20 to fold over filters 30 when guide members 70 are retracted along the respective extents of rods 60. Planar surface 110 disposed between filters 30 provides a flat surface against which visor 20 is stored when hood 10 is folded in the manner depicted in FIG. 9. Planar surface 100 may be integral to filters 30 or detachable when the hood is in an unpackaged state. Alternative means exist to lock each guide member 70 at a location on each rod 60 when visor 20 is in its retracted configuration. In FIG. 8, guide member 70 is secured to mounting member 61 that is in turn secured to filter 30 by hook and loop interface 73, otherwise known under the brand name VELCRO. This embodiment eliminates rod 60. Other embodiments may include utilizing snap buttons, peel-away adhesive, or any other mechanical coupling as known in the art to secure second end 72 of guide member 70 to mounting member 61.

In the embodiments that employ rod 60, it is preferred that rod 60 be formed of substantially rigid polymer construction to withstand heat, humidity and physical impact. Guide member 70 is preferably constructed of resilient elastomeric material that forms a slideable interference fit with rod 60.

Figure 9:
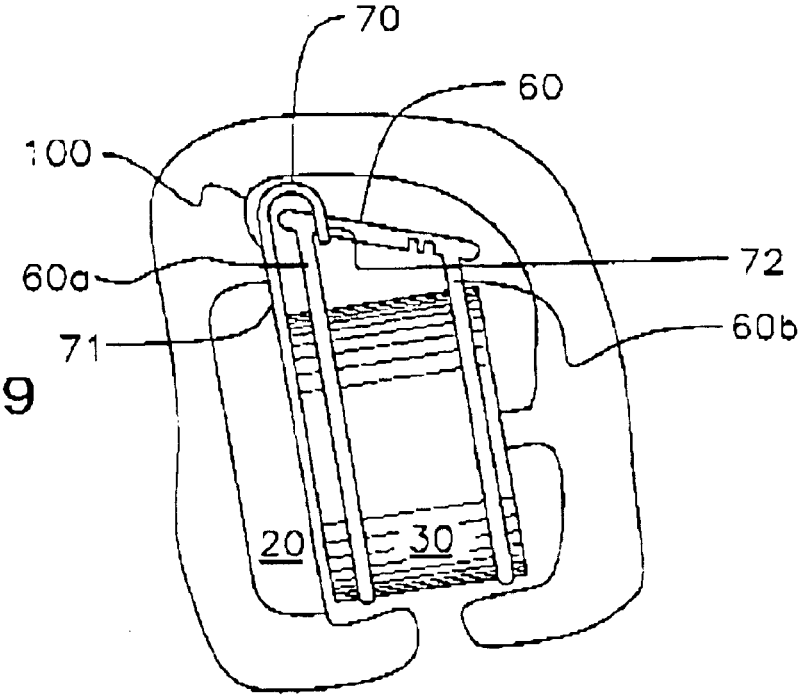
FIG. 9 is a side elevation view of an embodiment of the invention in a packaged state.

In FIG. 9, as mentioned above, visor 20 is folded over filter 30 to lie in flat, overlapping relation to planar surface 110. Guide member 70 is flexed between first end 71 and second end 72 to accommodate the folding. Visor 20 is thereby protected from optically damaging creasing when so stored.

Figure 10:
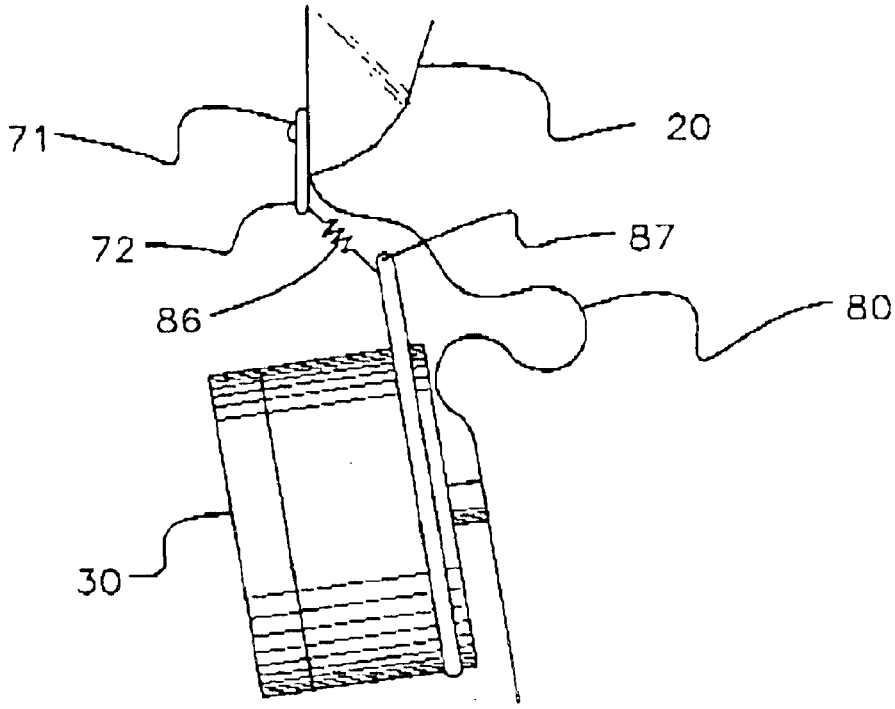
FIG. 10 is a side elevation detail view of an embodiment of the invention utilizing a resilient tension spring to vertically restrain the position of the visor relative to the ocular area of the wearer.

FIG. 10 is an embodiment of the invention utilizing a resilient tension spring 86 to interconnect guide member 70 to mounting member 61. When the apparatus is in a packaged state, resilient tension spring 86 is pulled to an extended position under tension. When the apparatus is unpacked, spring 86 pulls the visor down and towards the ocular area of the wearer, thereby creating slack fold 80.

Figure 11:
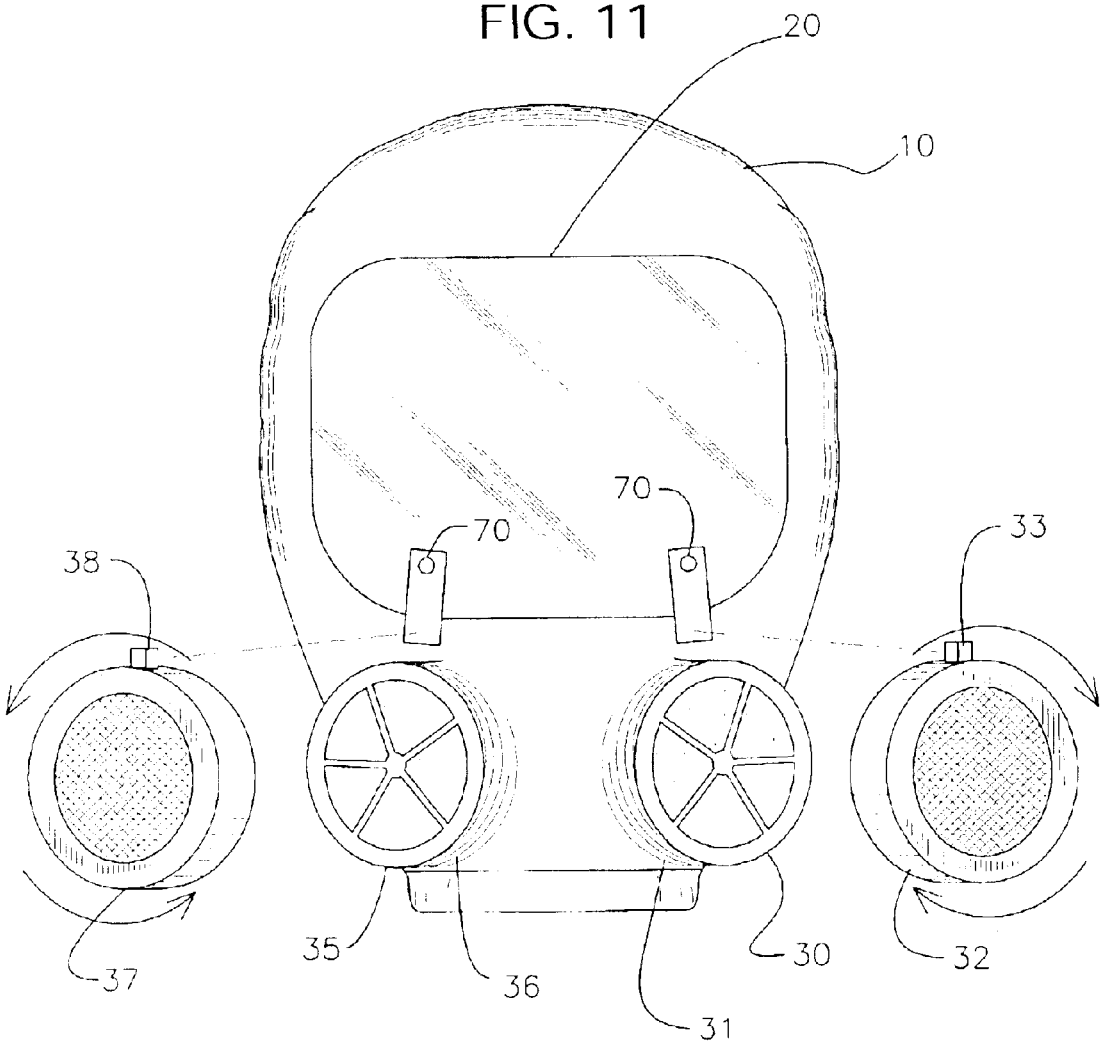
FIG. 11 is a front elevation, partially exploded view of an alternative embodiment of the invention.

In FIG. 11, filters 31 and 35 are secured to hood 10 in angled relation to visor 20, threaded in opposite relation relative to one another and adapted to screw threadedly receive rings 32 and 37 respectively. Filters 31 and 35 are externally threaded and rings 32 and 37 are internally threaded. Securing points 33 and 38 on top of each ring 32 and 37 are coupled to guide members 70 whereby tightening of rings 32 and 37 pull visor 20 downward and towards the ocular area of the wearer.

What is claimed is:

1. A protective apparatus, comprising:

a flexible hood adapted to fully encapsulate a head of a user in a substantially airtight seal;

said flexible hood having an upper and lower part;

said upper part including a transparent visor;

said lower part including at least one filter;

said upper part having a first, extended position where said visor is adapted to be spaced a first predetermined distance from said user's eyes, said first, extended position being a position of repose of said upper part;

said upper part having a second, retracted position where said visor is adapted to be spaced a second predetermined distance from said user's eyes, said second predetermined distance being less than said first predetermined distance;

said upper part being adjustable between said extended position and said retracted position;

said lower part having a fixed position;

said protective apparatus adapted to protect said user when said upper part is in said extended position, when said upper part is in said retracted position, and when said upper part is in any preselected position between said extended and retracted positions.

2. The protective apparatus of claim 1, further comprising:

a guide member having an upper end secured to said upper part at a lower end thereof said guide member depending from said lower end of said upper part;

a rod mounted to said at least one filter in vertically spaced relation to said filter, said rod being generally horizontally disposed and said rod having a longitudinal axis of symmetry that is positioned substantially perpendicular to a plane of said visor;

a lower end of said guide member being slideably engaged to said rod;

said upper part of said flexible hood being in said extended position when said lower end of said guide member is positioned at a first end of said rod;

said upper part of said flexible hood being in said retracted position when said lower end of said guide member is positioned at a second end of said rod; and said lower part of said flexible hood having a position of repose that is unaffected by displacement of said upper part of said flexible hood from said extended position to said retracted position and from said retracted position to said extended position.

3. The protective apparatus of claim 2, further comprising:

a locking means for securing said guide member to said rod when said guide member is positioned in said retracted position;

said protective hood occupying less space when said guide member is in said retracted position;

whereby said protective hood is adapted to be stored when said guide member is in said retracted position.

4. The protective apparatus of claim 3, further comprising:

said locking means including at least one notch formed in said rod member near said second end of said rod;

said lower end of said guide means being engaged to said at least one notch when said upper part is in said retracted position.

5. The protective apparatus of apparatus of claim 2, further comprising:

said guide member being formed of an elastomeric material; and said guide member forming a resilient interference fit with said rod.

6. The protective apparatus of claim 1, further comprising:

a slack fold formed in said flexible hood between said upper part and said lower part when said upper part is displaced from said first, extended position to said second, retracted position.

7. The protective apparatus of claim 6, further comprising:

said at least one filter having a flat front wall;

said flexible hood having a packaged configuration where the flexible hood is folded about said slack fold and where the visor overlies the flat front wall of said at least one filter.

8. The protective apparatus of claim 7, further comprising:

a guide member having an upper end secured to said upper part at a lower end thereof, said guide member depending from said lower end of said upper part;

a rod mounted to said at least one filter in vertically spaced relation to said filter, said rod being generally horizontally disposed and said rod having a longitudinal axis of symmetry that is positioned substantially perpendicular to a plane of said visor;

a bias means carried by said rod;

said bias means adapted to urge said guide member and hence said upper part into said extended position;

said bias means being loaded when said visor overlies said flat front wall of said filter;

whereby upon unfolding said flexible hood, said bias means unloads and displaces said guide member and hence said upper part from said retracted position into said extended position.

9. The protective apparatus of claim 7, further comprising:

said at least one filter comprising a pair of laterally spaced apart filters;

each filter of said pair of filters having a flat front wall;

a substantially planar surface that extends between and that is secured at opposite ends of the substantially planar surface to respective filter of said pair of filters;

whereby when said flexible hood is folded at said slack fold, said visor overlies respective flat front walls of said filters and said substantially planar surface.

10. The protective apparatus of claim 9, further comprising:

said substantially planar surface being detachably secured so that the substantially planar surface may be removed when the protective hood is in an unfolded configuration.

11. The protective apparatus of claim 1, further comprising:

said lower part of said flexible hood being recessed with respect to said upper part of said flexible hood when said upper part is extended;

said at least one filter having a flat front wall that is substantially co-planar with said visor when said upper part is in said extended position;

said at least one filter having a flat rear wall that is substantially co-planar with said visor when said upper part is in said retracted position.

12. The protective apparatus of claim 1, further comprising:

a guide member having an upper end secured to said upper part at a lower end thereof, said guide member depending from said lower end of said upper part; and a releasable fastener for directly interconnecting said guide member and said at least one filter so that said at least one filter is in an extended position when said upper part of said flexible hood and hence said guide member is in said extended position and so that said at least one filter is in a retracted position when said upper part of said flexible hood and hence said guide member is in said retracted position.

13. The protective apparatus of claim 12, further comprising:

said releasable fastener being a hook and loop fastening means for releasably attaching said guide member to said at least one filter.

14. The protective apparatus of claim 12, further comprising:

said releasable fastener being a snap and buckle fastening means for releasably attaching said guide member to said at least one filter.

15. The protective apparatus of claim 1, further comprising:

a guide member having an upper end secured to said upper part of said flexible hood at a lower end thereof, said guide member depending from said lower end of said upper part;

a bias means having a first end secured to a lower end of said guide member;

a second end of said bias means secured to said at least one filter.

16. The protective apparatus of claim 1, further comprising:

a rod mounted to said at least one filter in vertically spaced relation to said filter, said rod being generally horizontally disposed and said rod having a longitudinal axis of symmetry that is positioned substantially perpendicular to a plane of said visor;

said visor being positioned lower relative to the ocular area when said upper part of said flexible hood is in said retracted position; and said visor being positioned higher relative to the ocular area when said upper part of said flexible hood is in said extended position.

* * * * *